US007131249B2

(12) United States Patent
Michelotti

(10) Patent No.: US 7,131,249 B2
(45) Date of Patent: Nov. 7, 2006

(54) PRODUCT OVERWRAP MACHINE

(75) Inventor: William M. Michelotti, Stamford, CT (US)

(73) Assignee: Steinmetz Machine Works, Inc., Stamford, CT (US)

( * ) Notice: Subject to any disclaimer, the term of this patent is extended or adjusted under 35 U.S.C. 154(b) by 75 days.

(21) Appl. No.: 10/989,048

(22) Filed: Nov. 15, 2004

(65) Prior Publication Data

US 2005/0115209 A1 Jun. 2, 2005

Related U.S. Application Data

(60) Provisional application No. 60/519,604, filed on Nov. 13, 2003.

(51) Int. Cl.
*B65B 57/00* (2006.01)
*B65B 11/00* (2006.01)

(52) U.S. Cl. ..... 53/493; 53/57; 53/58; 53/504

(58) Field of Classification Search ..... 53/56, 53/57, 58, 73, 74, 76, 493, 496, 504, 466, 53/228

See application file for complete search history.

(56) References Cited

U.S. PATENT DOCUMENTS

| | | | | |
|---|---|---|---|---|
| 2,934,869 | A * | 5/1960 | Engleson et al. | 53/57 |
| 3,783,577 | A * | 1/1974 | Knutson et al. | 53/74 |
| 3,868,807 | A * | 3/1975 | Noyes et al. | 53/74 |
| 4,033,088 | A * | 7/1977 | Markert | 53/73 |
| 4,506,488 | A | 3/1985 | Matt et al. | 53/55 |
| 4,574,566 | A | 3/1986 | Eaves et al. | 53/450 |
| 4,726,168 | A | 2/1988 | Seko | 53/450 |
| 4,924,657 | A | 5/1990 | Berti et al. | 53/450 |
| 4,947,623 | A | 8/1990 | Saito et al. | 53/493 |
| 5,001,884 | A * | 3/1991 | Hanagata | 53/58 |
| 5,042,229 | A | 8/1991 | Hirose | 53/450 |
| 5,138,815 | A | 8/1992 | Groschen, Jr. | 53/55 |
| 5,341,623 | A | 8/1994 | Siegel | 53/433 |
| 5,524,420 | A | 6/1996 | Ikuta | 53/450 |
| 5,566,526 | A | 10/1996 | Suga | 53/75 |
| 5,600,938 | A | 2/1997 | Trimble | 53/417 |
| 5,655,356 | A * | 8/1997 | Ginestra et al. | 53/504 |
| 6,349,526 | B1 * | 2/2002 | Newman | 53/504 |
| 6,574,944 | B1 | 6/2003 | Capodieci | 53/450 |

* cited by examiner

*Primary Examiner*—Louis Huynh
(74) *Attorney, Agent, or Firm*—St. Onge Steward Johnston & Reens LLC

(57) ABSTRACT

A typical product overwrap machine includes a crossfeed conveyor, a pusher bar for transferring bread products to a lifting table which moves upwardly to wrap the bread product with a sealing wrap, and the wrapped bread product is sealed by heated rollers. The present invention provides a sensor and control systems operating servomotors or AC drives so that the crossfeed conveyor is operated only when product is detected at a conveyor inlet, and the pusher bar is actuated to move the product from the crossfeed conveyor when product is detected. The control systems detect the width of a pusher bar plate and adjust the separation of flight bars in the crossfeed conveyor to match the size of the installed pusher bar plate, thereby preventing damage to the crossfeed conveyor if there is a mismatch in sizes. Other control systems may be provided to adjust both the width of the pusher bar and the separation of flight bars in the crossfeed conveyor.

27 Claims, 6 Drawing Sheets

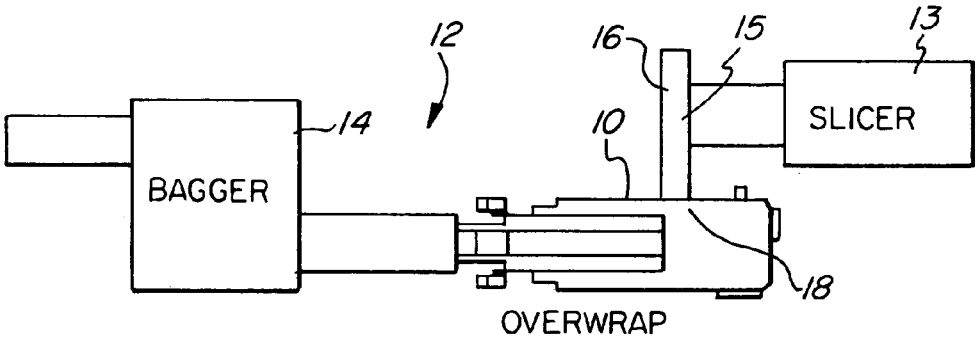
FIG. 1
FIG. 2
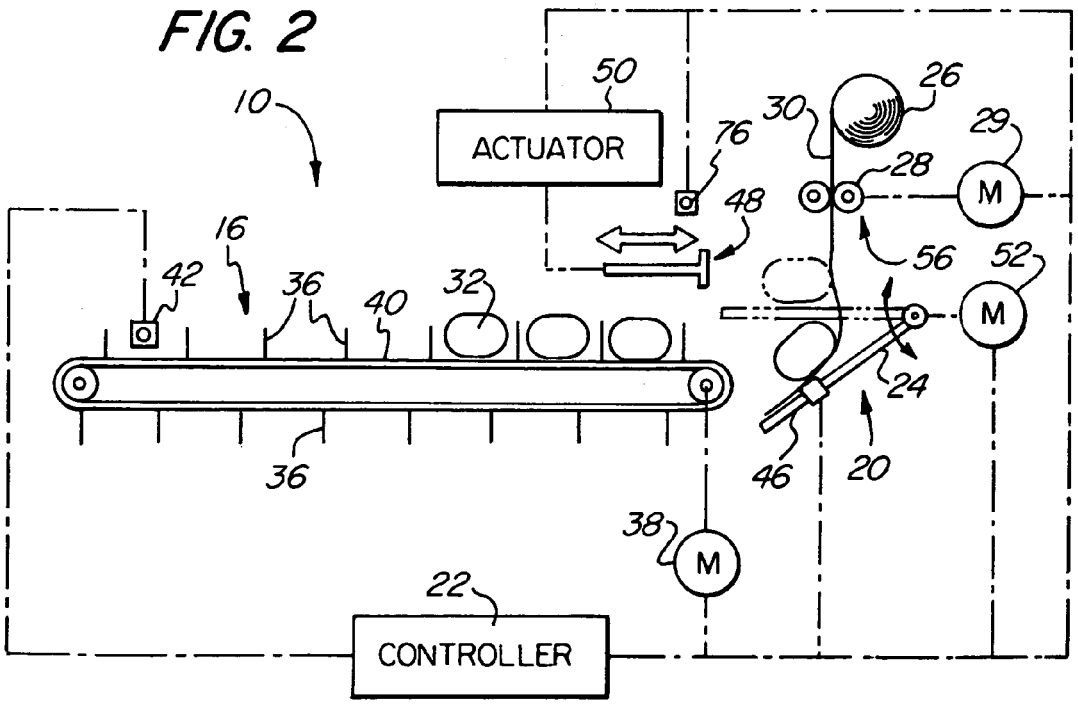

PRODUCT OVERWRAP MACHINE

PRIOR APPLICATION

Applicant claims priority benefits under 35 U.S.C. §119 (e) of U.S. Provisional Patent Application Ser. No. 60/519,604 filed Nov. 13, 2003.

FIELD OF THE INVENTION

The present invention relates to machinery in the field of food packaging, and particularly to overwrap machines for packaging resilient foodstuffs such as bread.

BACKGROUND OF THE INVENTION

Commercial bakeries often package baked bread in an overwrap, which is a plastic sheet wrapper that contains the bread. This overwrap may be the sole airtight packaging for the bread or the bread and its overwrap may be bagged, for example within a plastic bag tied with a twist tie or a clip closure.

A commonly used bread overwrap machine has been manufactured by many corporations such as AMF Incorporated. As shown in FIG. 1, such a bread overwrap machine 10 may, for example, be located in a bakery line 12 after a bread slicer 13 and before a bagger 14. The bread overwrap machine 10 typically has a crossfeed conveyor 16 that picks up individual loaves of bread from the end 15 of a conveyor from the bread slicer 13 and transports them, one loaf at a time, in an end to end (heel to heel) orientation. Each loaf is transported by the crossfeed conveyor in a pocket, formed by a pair of spaced apart flight bars, that moves the loaf from the pick up point 15 to a position 18 in the overwrap machine 10, where it is pushed by a pusher bar onto a reciprocating lifting table. The lifting table moves between a lower position where it receives the loaf of bread, to an upper position where the loaf of bread is removed from the lifting table, at which point the lifting table returns to its lower position. The lifting table, as it lifts the loaf from the lower position to the upper position, lifts the loaf through a web of overwrap material (which is typically a transparent polypropylene film) causing the film to wrap around the loaf of bread, and creates a folds in the film at the end of the loaf. A knife cuts the film as the lifting table reaches its upper position, where the loaf is pushed by an overhead conveyor. The loaves of bread are conveyed laterally through a sealing line such that the folded wrap at the ends of the loaves is sealed by a heated mesh belt or heated rollers along the sides of the conveyor line, as the loaves are conveyed through the machine. A preferred sealing line assembly is disclosed in my U.S. Pat. No. 5,058,362, the disclosure of which I hereby incorporated by reference.

The movement of the various components of the overwrap machine are mechanically coupled together and indexed so that the loaves of bread are delivered one at a time to the lifting table. In particular, the movement of the crossfeed conveyor is a periodic movement that is indexed to the reciprocating movement of the lifting table, so that each pocket containing a loaf of bread arrives in the correct position for the loaf to be transferred to the lifting table when the lifting table is in its lower position. The indexed movement is obtained by interacting cam elements.

Such overwrap machines are typically are provided with mechanisms for adjusting the distance between the flight bars which form the pockets for receiving the baked bread, so as to accommodate different size bread products in the line. The mechanism includes two side-by-side endless chains, one chain which has affixed to it the leading flight bars of each set of flights forming a pocket, the other chain having affixed to it the trailing flight bars of each set of flights forming a pocket. The distance between the flight bars of each pocket set is adjusted by moving the two chains with respect to each other. Moving one conveyor with respect to the other changes the spacing between each set of flight bars.

Such bread overwrap machines typically have a maximum processing rate of approximately 65 loaves per minute. The overwrap machines can act as a bottleneck in production where the baking equipment is capable of higher throughput rates, such as rates of approximately 100 loaves per minute for a bread slicer.

It would be desirable to improve the processing speeds of overwrap machines to receive the output of a slicer, to thereby maximize the production rate at bakeries where the baking equipment is capable of higher throughput rates than in conventional overwrap machines. It would also be desirable to provide a more flexible control system for the overwrap machine that the limited "on/off" status typically associated with traditional overwrap machines, and to provide for automated adjustment of machine components and automated response to changes in product, machine settings, or bakery line changes.

SUMMARY OF THE INVENTION

The present invention is generally directed to a new overwrap machine for packaging resilient foodstuffs such as bread with improved control system for synchronized control of the machine.

The present invention is a product overwrap machine having: a crossfeed conveyor having two electric drives, each driving a drive chain or belt having a plurality of flight bars operatively coupled thereto; a lifting table positioned next to the conveyor and moveable between a lower position for receiving product from the conveyor, through a film of overwrap material to fold and wrap the product, to an upper position for delivering the wrapped product to a sealing line; a pusher bar positioned adjacent to the lifting table for pushing product from the crossfeed conveyor onto a lifting table which is also operated by an electric drive and an appropriate mechanical linkage; in which the overwrap machine is provided with sensor and control systems providing a number of functions.

According to one embodiment of the invention, a control system for a product overwrap machine with a conveyor, a lifting table, and a pusher bar is provided, in which the control system comprises: a first sensor system for detecting product presence in the conveyor; a second sensor system for detecting a possibility of interference between the pusher bar and flight bars of the conveyor; and, a controller for controlling operation of the overwrap machine in response to information detected from the first and second sensor systems.

The control system of the invention may further comprise a third sensor system for inspecting product acceptability, and the controller accepts product for the overwrap and sealing step only if the product is acceptable.

The specific system functions include one or more of the following. The first control system function detects product presence at an inlet position on the crossfeed conveyor, and controls operation of the machine in response to the information detected from the sensor system. The sensor system detects product presence at a specific position of the conveyor and operates the crossfeed conveyor when product is present. If no product is detected at the inlet for a certain period of time, the crossfeed conveyor system will be shut down. The second control system function is detecting the width of a pusher bar plate installed on the pusher bar and adjusting the spacing between flight bars of the conveyor in response to the detected pusher bar plate width, or alternatively, in response to manually inputted width information. The spacing between sealing elements such as heated rollers in the sealing line may also be automatically adjusted in response to these inputs. A third control system function is detecting product in the crossfeed conveyor at the location of the pusher bar and actuating the pusher bar so that product is transferred from the crossfeed conveyor to the lifting table when product is present. A fourth control system function is a quality control vision system that operates to block actuation of the pusher bar if product of unacceptable quality is detected, so that if the detected product is not commercially acceptable it is allowed to be passed to a rejection area.

In a preferred embodiment, a programmable logic control module is included that is programmed to prevent any manual override or other adjustment to the flight bar spacing that would risk damage from the pusher bar.

In another preferred embodiment, the width of the pusher bar width is automatically adjusted. This may be implemented by a threaded screw attached to one half plate acting on a threaded nut affixed to a second half plate. Desirably, the threaded screw is actuated by a servomotor/AC drive to automatically resize the pusher bar to a detected spacing between flight bars.

BRIEF DESCRIPTION OF THE DRAWINGS

FIG. 1 is a schematic view of a typical bakery machine including a bread overwrap machine which can generally be applied to the product overwrap machine of the invention.

FIG. 2 is a schematic view of the overwrap machine illustrating the principles and a general construction according to the present invention.

DETAILED DESCRIPTION OF THE DRAWINGS

Figure 3:
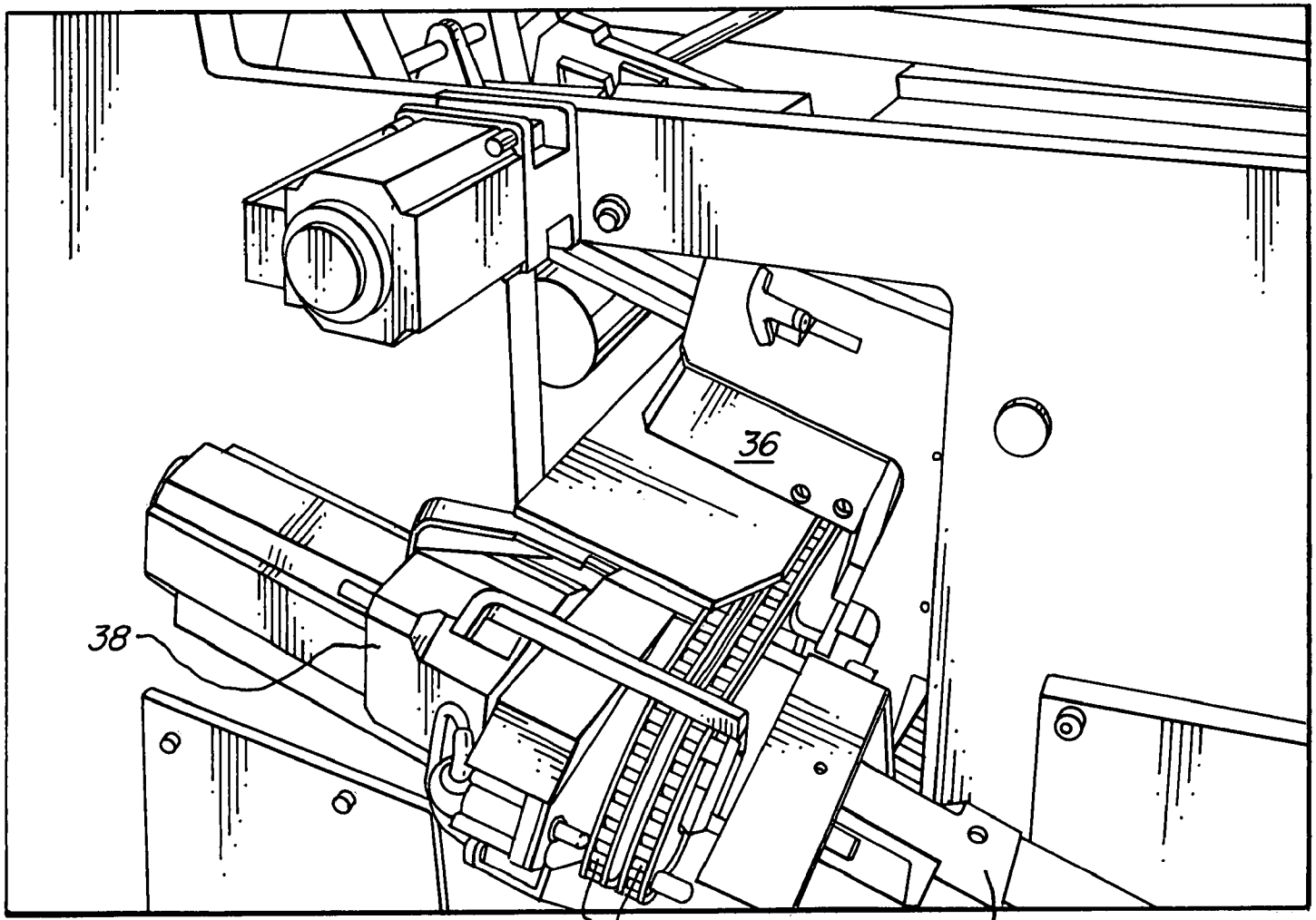
FIG. 3 is a photographic view illustrating the crossfeed conveyor of the invention having two separate servomotor coupled thereto.

The above described and other features and advantages of the present invention will become more apparent by describing in further details illustrative embodiments of the invention with reference to the drawings.

Referring to FIG. 2, a product overwrap machine of the invention is schematically illustrated to show the concepts and operation of the invention. The overwrap machine 10 is composed generally of crossfeed conveyor 16, main machine body 20, and at least one control system or controller 22 attached to the main body 20 for controlling the function and wrapping processes of the machine. The main body includes a housing structure and retains a wide variety of functional components and mechanisms such as lifting table 24, a roll of sheet film 26, and feeder roller 28 coupled with a motor 29 for feeding thin film 30 to wrap a product (such as a loaf of bread) 32 at a time which is consecutively transferred onto the lifting table 24 of the machine.

Referring to FIGS. 2 and 3, the crossfeed conveyor 16 includes two endless chains 34 (alternatively, belts as described in the Provisional Application No. 60/519,604 to which the present application claims priority and which is hereby incorporated by reference). Each of the chains 34 carries a plurality of flight bars 36, each driven by a separate AC drive 38 or other servomotor or actuator known in the art (this group of products may be referred to in this application as "electrical drives"). The flight bars define a plurality of pockets 40 for transporting a bread loaf 32 or other product. A pair of flight bars, one attached to one chain or belt, the other attached to the other chain or belt, defines each pocket. The positioning of one chain relative to the other defines the distance between each flight bar in the pair of flight bars that define a pocket 40.

Figure 4:
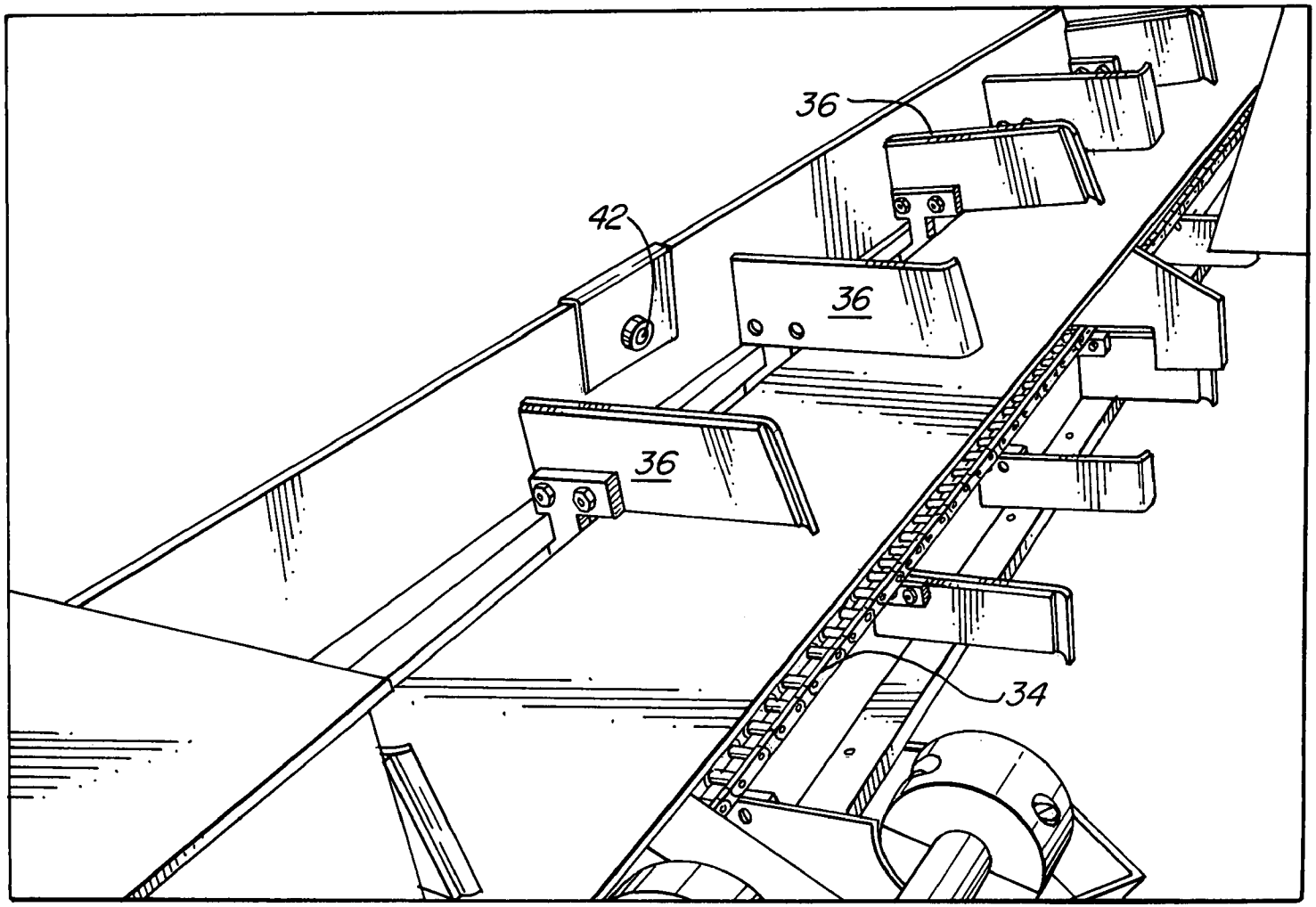
FIG. 4 is a photographic view illustrating further details of the crossfeed conveyor of the invention.

Referring to FIGS. 2 and 4, a sensor or vision system 42 is provided to detect the presence of the product, preferably disposed in at the crossfeed inlet. When the product 32 is detected, the AC drives 38 are actuated to move the flight bars 36 of the conveyor 16 and thus driving a stepped sideway movement of the product 32. However, if the product 32 is not detected for a predetermined period of time, the servomotor 38 stops and the conveyor 16 does not move. Additional subsystems of the overwrap machine may be programmed to enter a power saving idle mode as well, either immediately or after a selected period of time, for example, heating of the sealing rollers may be shut off. If this stop time lasts for a substantial amount of time (for example 20 minutes) the entire machine may be programmed to completely power down. Thus, unnecessary running of the conveyor 16 and/or the entire machine can be avoided. Accordingly, the invention provides reduced electric power consumption, and reduced wear and tear, leading to extension of the operating life of the overwrap machine 10. An important benefit of the automatic shutdown of unnecessary systems is improved safety and working environment for the operators of the machine. Because continuous movement of conveyors and other parts is shut down, the risk of personal injury to a careless operator is reduced.

In one potential embodiment of the invention, the vision system 42 is used to determine the size of the product and one (or both) AC drive is activated sufficiently to alter the relative position of the two chains 34 (or belts), causing a change in the separation of each pair of spaced part flight bars 36. Thus the size of the pocket formed by the flight bars is adjusted to match the size of the incoming product. The vision system 42 can be formed with one or plural photoelectric sensors, proximity sensors, limit switches, or other known sensor systems usable for detection of the presence and size of the product.

Referring to FIG. 2, the product 32 is advanced to a lifting table 24 of the main body 20 (the details not shown). Adjacent to the lifting table 24, a product inspection vision system or sensor 46 is preferably provided for inspecting the product size and appearance. Unacceptable product is not pushed onto the lifting table 24 and is passed laterally to a crossfeed outlet area (not shown). When acceptable product is detected by the inspection system 46 (such as a photoelectric senor or proximity sensor), it will activate pusher bar 48 by an actuator 50 coupled thereto, for example, through the actuation of a solenoid (not shown) of the actuator 50. Thus, acceptable product is pushed by the pusher bar onto the lifting table 24.

The lifting table 24 moves between a lower position (shown with solid lines) where it receives the loaf of bread 32, to an upper position (shown in broken lines) where the loaf of bread 32 is removed from the lifting table after wrapping with the film 30, at which point the lifting table returns to its lower position. The lifting table 24, as it lifts the loaf from the lower position to the upper position, lifts the loaf 32 through a web of overwrap material 30 (which is typically a transparent polypropylene film) causing the film to wrap around the loaf of bread, and creates a first fold in the film at the end of the loaf. The lifting table 24 then reaches the upper position by actuation of a motor 52 as indicated by an arrow in FIG. 2, where the loaf 32 is pushed onto a conveyor (not shown) of a subsequent sealing operation; in this process additional folds are made at the ends of the loaf 32. The loaves of bread are conveyed laterally through the overwrap machine 10 such that the folded wrap at the ends of the loaves is sealed by a heated mesh belt or heated rollers of the type disclosed in U.S. Pat. No. 5,058,362 along the sides of the conveyor line, as the loaves are conveyed through the machine.

Figure 5:
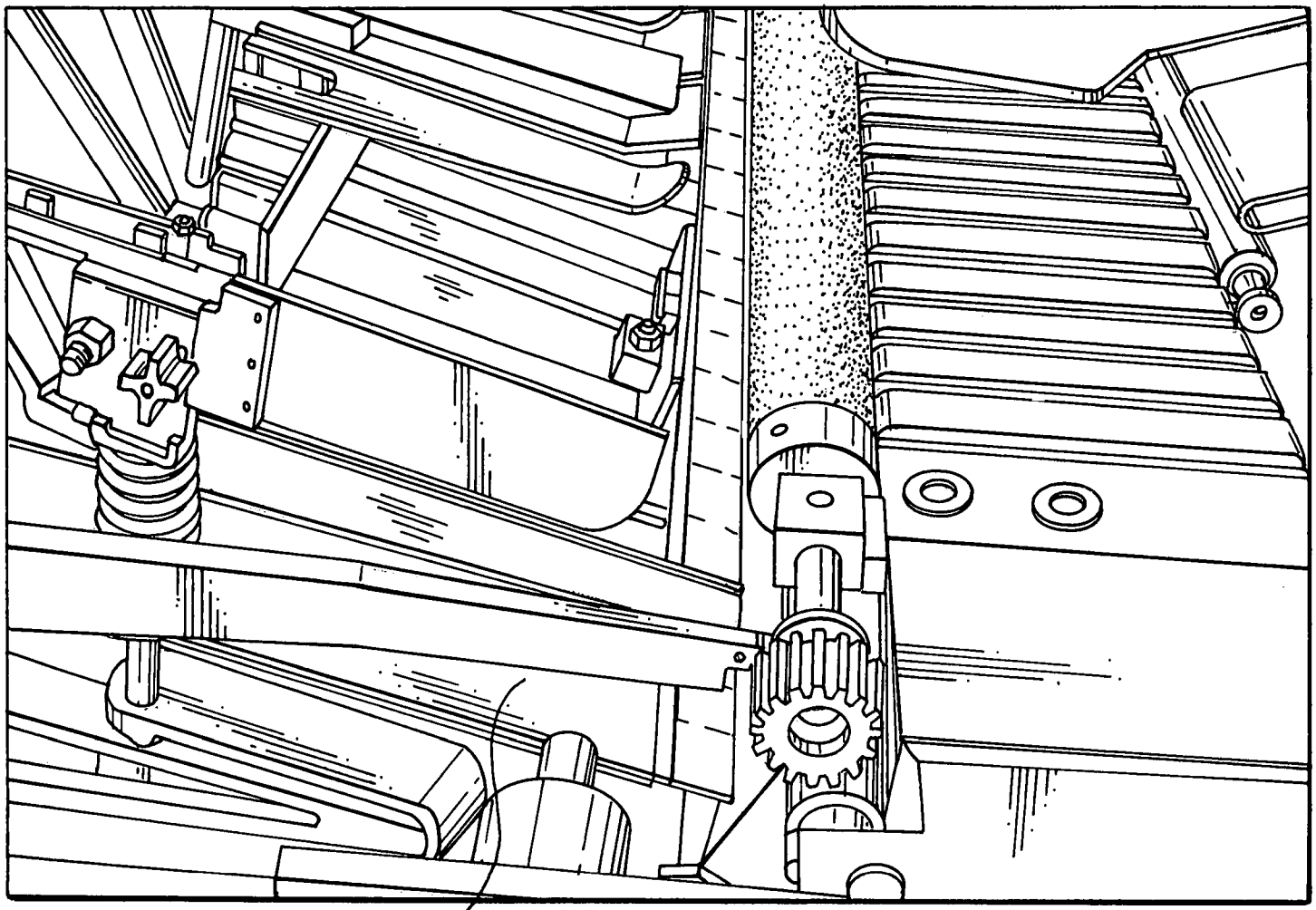
FIG. 5 is a photographic view illustrating the lifting table of the invention in the lower or intermediate position.
Figure 6:
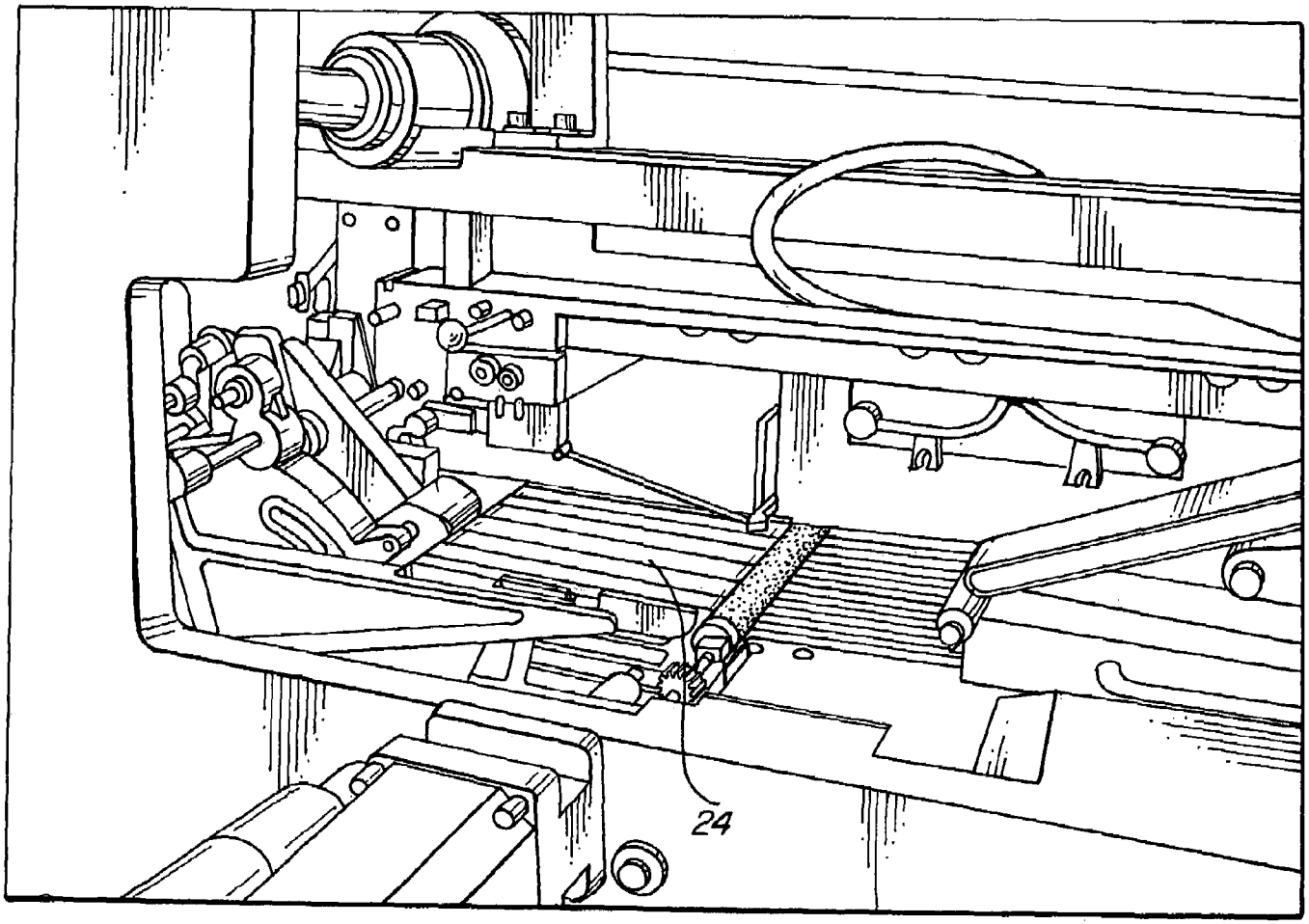
FIG. 6 is a photographic view illustrating the lifting table of the invention in the upper position.

FIGS. 5 and 6 show the states where the lifting table 24 is in the lower position and in the upper position, respectively, without showing the loaf 32 thereon. It is noted that the wrap machine 10 preferably includes a pair of fingers or holders disposed adjacent the lifting table 24 for securely holding the loaf 20 on the table during the reciprocal movement of the table and until removal from the table by the pusher bar 48. The fingers are preferably actuated by an electrical drive. In addition, a suitable cutting knife 56 (FIG. 2) is also provided for cutting the film 30 during the wrapping process of the product.

Figure 7:
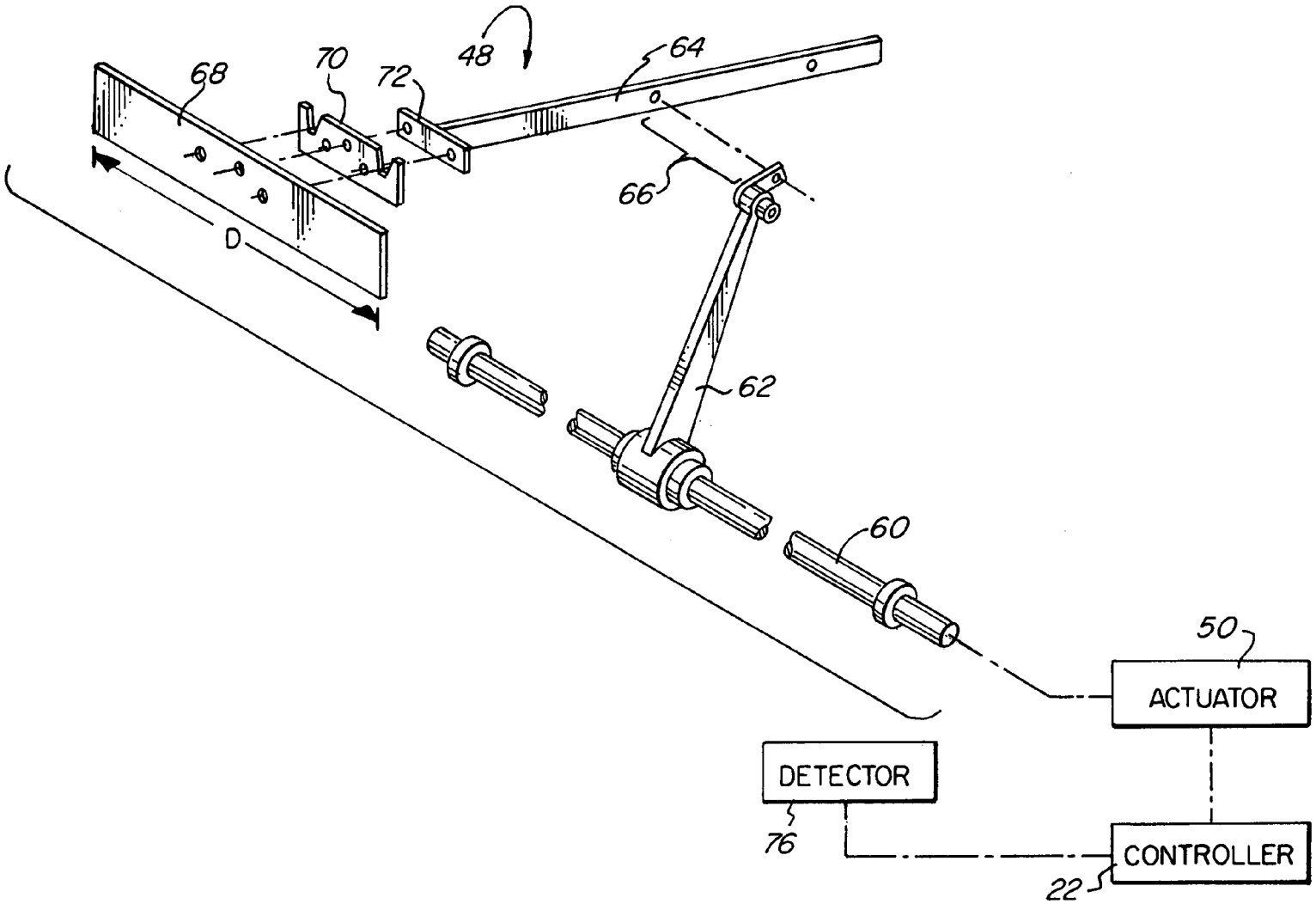
FIG. 7 is a disassembled view of one example of the pusher bar of the invention in association with the control system of the invention.

Referring to FIG. 7, one illustrative embodiment of the pusher bar 48 is shown. The pusher bar 48 includes a rotor shaft 60 operatively connected to the actuator 50, such as an AC drive or servomotor, which is in turn coupled with the controller 22 (to be described below in detail). The pusher bar 48 further includes a rotor arm 62 extending laterally from the shaft 60 and connected to a pusher rod 64 via a conventional link connection 66. A pusher bar plate 68 and support plate 70 is connected at a distal end 72 of the pusher rod 64.

If the distance between the flight bars 36 for carrying the product 32 is less than the width "D" of the pusher bar plate 68 of the pusher bar 48, the pusher bar plate 68 will crash into the flight bars 36 during the above-described pushing movement of the loaf 32 on the table 24, thus damaging the crossfeed conveyor 16 and slowing or halting the bakery line. To avoid this potential problem, the overwrap machine is preferably provided with a sensor or detection system 76 (FIGS. 2 and 7) disposed adjacent to the pusher bar plate 68 for preventing actuation of the pusher bar solenoid if the optical detection system 76 detects that the pusher bar plate 68 has a width greater than the separation between associated opposing flight bars in each pair of flight bars. Even if the operator of the machine 10 has installed a pusher bar plate without adjusting the machine to accommodate the new size pusher bar plate, the control system prevents actuation of the pusher bar, and will further resize the distance between the flight bars 36 to conform to the width of the pusher bar plate.

Alternatively, in one preferred embodiment of the invention, the pusher bar 48 of the machine 10 may provide an automatic length adjustment mechanism (not shown) in the pusher bar 48 for adjusting the length "D" of the pusher plate 68. For example, this may be implemented by a threaded screw (not shown) attached to one half plate acting on a threaded nut (not shown) affixed to a second half plate. Desirably, the threaded screw is actuated by a servomotor/AC drive to automatically resize the pusher plate 68 to a detected spacing between flight bars 36.

As described herein above, the controller 22 is coupled with the actuators or servomotor 29, 38, 50, and 52 for controlling the operative components of the machine 10 such as the conveyor 16, lifting table 24, film feeder 28, and pusher bar 48, etc. Each AC drive/servomotor may include a motor controller (not shown) and/or an encoder (not shown) coupled with the controller 22 for servo-control of the components. The controller 22 is further respectively coupled with the sensor systems corresponding to the operative components for automatic and synchronized control of the machine 10, e.g., sensor 42 for the conveyor 16, sensor 46 for lifting table 24, sensor 76 for movement of pusher bar 48, etc.

According to one preferred embodiment, the controller 22 includes a programmable logic controller (PLC) connected with the actuators 29, 38, 50, and 52 and the sensor systems 42, 46, 76, etc. The programmable logic control module can be programmed for systematic, synchronized, and safe operation of the machine 10. For example, the PLC unit can be programmed to prevent any manual override or other adjustment to the flight bar spacing that would risk damage from the pusher bar. Other control systems may be used, including indexed systems or sized coded systems for facilitating the automated operation of the machine 10, for example, to adjust the separation between the heating elements in response to manually inputted or measured or detected changes in either the pusher bar plate, or the product itself. Preferably, the control system allows the bakery equipment to detect the flight bar spacing (or positioning) and compare the spacing to the width (or positioning) of the pusher bar, and preventing actuation of the solenoid of the pusher bar if there is a sizing mismatch.

According to another preferred embodiment, the controller 22 may include a computer such as PC in addition to a programmable logic controller (PLC) for adequate control of the machine 10.

While this invention has been particularly described and shown with reference to preferred or illustrative embodiments thereof, it will be understood by those skilled in the art that various changes and modifications in form and details may be made thereto without departing from the spirit and scope of the invention as defined by the appended claims.

What is claimed is:

1. A product overwrap machine comprising:

a crossfeed conveyor having adjacent electric drives each driving a loop positioned adjacent to one another, each loop having a plurality of flight bars affixed thereto, adjacent opposing flight bars of the adjacent loops forming pairs of flight bars, said crossfeed conveyor having an inlet position;

a first sensor for detecting product presence at said inlet position of said conveyor and providing a first product detecting output;

a lifting table positioned next to said conveyor and moveable between a lower position and an upper position;

a pusher bar positioned adjacent to said lifting table for pushing product transversely from said crossfeed conveyor onto said lifting table when actuated by a pusher bar electric drive, said pusher bar having a pusher bar plate having a width;

a second sensor for detecting the width of the pusher bar plate and providing a pusher bar plate width output;

a control system for controlling operation of said crossfeed conveyor according to the first product detecting output of said first sensor; and wherein said control system receives said pusher bar plate width output and operates said electric drives to position flight bars of each pair of flight bars apart a sufficient distance such that a distance between opposing flight bars in each pair of flight bars is greater than the width of the pusher bar plate.

2. A product overwrap machine in accordance with claim 1, wherein said control system initiates operation of said electric drives of said crossfeed conveyor if product is detected by said first sensor.

3. A product overwrap machine in accordance with claim 2, wherein said control system idles operation of said electric drives of said crossfeed conveyor after a selected period of non detection of product by said first sensor.

4. A product overwrap machine in accordance with claim 1, wherein said flight bars are prevented by said control system from being spaced apart a distance which is less than the width of the pusher bar plate.

5. A product overwrap machine in accordance with claim 1, wherein said control system receives said pusher bar plate width output and sets at least one overwrap machine adjustment related to product width to a setting related to said pusher bar width.

6. A product overwrap machine in accordance with claim 5, wherein said at least one overwrap machine adjustment is a distance between opposing heat sealing elements in a sealing line.

7. A product overwrap machine in accordance with claim 1, further comprising a lifting table sensor for detecting product presence at a lifting table position and providing a second product detecting output, and wherein said pusher bar is actuated in response to said second product detecting output.

8. A product overwrap machine in accordance with claim 7, wherein said pusher bar is prevented from actuation by said control system if the control system detects that the pusher bar has a width which exceeds a spacing between a pair of flight bars of said conveyor.

9. A product overwrap machine in accordance with claim 7, further comprising a product inspection machine vision system to inspect product conformance with predetermined quality standards, said lifting table being actuated only if said product conforms with said predetermined quality standards.

10. A product overwrap machine in accordance with claim 1, wherein said control system is operable to adjust spacing between flight bars of said conveyor in response to one or more of manually input, automatic detection, and automatic measurement of the width of said pusher bar plate.

11. A product overwrap machine in accordance with claim 10, wherein said control system sets at least one other overwrap machine adjustment related to product width to a setting related to said pusher bar width.

12. A product overwrap machine in accordance with claim 1, wherein said first sensor is adapted to further detect product size, and wherein spacing between flight bars of said conveyor is adjusted by the control system in response to the information detected from said first sensor.

13. A product overwrap machine in accordance with claim 12, wherein said pusher bar comprises two laterally slidable parts so that said pusher bar plate has an adjustable width.

14. A product overwrap machine in accordance with claim 13, wherein said control system is operable to adjust spacing between flight bars of said conveyor, and to adjust position of said two laterally slidable pads of said pusher bar plate so that the spacing between flight bars is greater than the width of said pusher bar plate, in response to one or more of manually input and sensor detected measurement of product size.

15. A product overwrap machine in accordance with claim 14, wherein said control system sets at least one other overwrap machine adjustment related to product width to a setting related to manually input and sensor detected measurement of product size.

16. A product overwrap machine in accordance with claim 1, wherein said pusher bar plate comprises two laterally slidable parts so that said pusher bar plate has an adjustable width.

17. A product overwrap machine in accordance with claim 16, wherein said pusher bar plate is provided with an interengaged mating screw and nut, said screw being actuated by a servomotor to adjust the width of said pusher bar plate.

18. A product overwrap machine comprising;

a crossfeed conveyor having adjacent electric drives each driving a loop positioned adjacent to one another, each loop having a plurality of flight bars affixed thereto, adjacent opposing flight bars of the adjacent loops forming pairs of flight bars, said crossfeed conveyor having an inlet position;

a first sensor for detecting product presence at said inlet position of said conveyor and providing a first product detecting output;

a lifting table positioned next to said conveyor and moveable between a lower position and an upper position;

a pusher bar positioned adjacent to said lifting table for pushing product transversely from said crossfeed conveyor onto said lifting table when actuated by a pusher bar electric drive, said pusher bar having a pusher bar plate having a width;

a second sensor for detecting the width of the pusher bar plate and providing a pusher bar plate width output;

a control system for controlling operation of said crossfeed conveyor according to the first product detecting output of said first sensor, said control system initiating operation of said electric drives of said crossfeed conveyor if product is detected by said first sensor and idling operation of said electric drives of said crossfeed conveyor after a selected period of non detection of product by said first sensor; said control system receiving said pusher bar plate width output and operating said electric drives to position flight bars of each pair of flight bars apart a sufficient distance such that the distance between opposing flight bars in each pair of flight bars is greater than the width of the pusher bar plate.

19. A product overwrap machine in accordance with claim 18, wherein said control system further comprises a control system for receiving said pusher bar plate width output and setting at least one overwrap machine adjustment related to product width to a setting related to said pusher bar width.

20. A product overwrap machine in accordance with claim 19, wherein said at least one overwrap machine adjustment is a distance between opposing heat sealing elements in a sealing line.

21. A product overwrap machine in accordance with claim 18, further comprising a lifting table sensor for detecting product presence at a lifting table position and providing a second product detecting output, and wherein said pusher bar is actuated in response to said second product detecting output.

22. A product overwrap machine in accordance with claim 21, further comprising a product inspection machine vision system to inspect product conformance with predetermined quality standards, said lifting table being actuated only if said product conforms with said predetermined quality standards.

23. A product overwrap machine comprising:

a crossfeed conveyor having adjacent electric drives each driving a loop positioned adjacent to one another, each loop having a plurality of flight bars affixed thereto, adjacent opposing flight bars of the adjacent loops forming pairs of flight bars, said crossfeed conveyor having an inlet position;

a first sensor for detecting product presence at said inlet position of said conveyor and providing a first product detecting output;

a lifting table positioned next to said conveyor and moveable between a lower position and an upper position;

a pusher bar positioned adjacent to said lifting table for pushing product transversely from said crossfeed conveyor onto said lifting table when actuated by a pusher bar electric drive, said pusher bar having a pusher bar plate having a width;

a control system for controlling operation of said crossfeed conveyor according to the first product detecting output of said first sensor, said control system initiating operation of said electric drives of said crossfeed conveyor if product is detected by said first sensor and idling operation of said electric drives of said crossfeed conveyor after a selected period of non detection of product by said first sensor; said control system preventing said flight bars from being spaced apart a distance which is less than a width of the pusher bar plate, said control system adjusting spacing between flight bars of said conveyor in response to one or more of manually input, automatic detection, and automatic measurement of the width of said pusher bar plate or one or more of manual input and automatic detection of product size.

24. A product overwrap machine in accordance with claim 23, further comprising a lifting table sensor for detecting product presence at a lifting table position and providing a second product detecting output, and wherein said pusher bar is actuated by said control system in response to said second product detecting output.

25. A product overwrap machine in accordance with claim 24, wherein said control system sets at least one other overwrap machine adjustment related to product width or pusher bar width.

26. A product overwrap machine in accordance with claim 23, wherein said pusher bar plate comprises two laterally slidable parts so that said pusher bar plate has an adjustable width.

27. A product overwrap machine in accordance with claim 23, further comprising a product inspection machine vision system to inspect product conformance with predetermined quality standards, said lifting table being actuated only if said product conforms with said predetermined quality standards.

* * * * *